US005503456A

United States Patent [19]

Rossini

[11] Patent Number: 5,503,456

[45] Date of Patent: Apr. 2, 1996

[54] HEADREST

[76] Inventor: Alfred P. Rossini, 1 Wyndemere Dr., Southboro, Mass. 01772

[21] Appl. No.: 328,860

[22] Filed: Oct. 25, 1994

[51] Int. Cl.[6] ..... A47C 7/38

[52] U.S. Cl. ..... 297/397; 224/151; 297/284.5

[58] Field of Search ..... 297/284.5, 397, 297/DIG. 6; 5/636, 640, 922; 224/151, 159, 224; 383/4

[56] References Cited

U.S. PATENT DOCUMENTS

| | | | |
|---|---|---|---|
| D. 247,312 | 2/1978 | Zeiss . | |
| D. 250,835 | 1/1979 | Grube . | |
| D. 286,239 | 10/1986 | Scheurer et al. . | |
| D. 312,019 | 11/1990 | Woods et al. . | |
| D. 330,989 | 11/1992 | Evans . | |
| D. 338,587 | 8/1993 | Harnish . | |
| 2,013,481 | 9/1935 | Stonehill . | |
| 4,097,086 | 6/1978 | Hudson | 297/397 X |
| 4,165,125 | 8/1979 | Owen . | |
| 4,815,154 | 3/1989 | Grimes . | |
| 4,844,540 | 7/1989 | Pegram | 297/229 |
| 4,877,288 | 10/1989 | Lee | 297/229 |
| 4,901,898 | 2/1990 | Colombo et al. | 224/159 |
| 5,027,457 | 7/1991 | Sweet . | |
| 5,224,637 | 7/1993 | Colombo | 224/159 |
| 5,240,156 | 8/1993 | Sicotte et al. | 224/151 |
| 5,275,318 | 1/1994 | Catania | 224/224 |

FOREIGN PATENT DOCUMENTS

| | | | |
|---|---|---|---|
| 385441 | 12/1932 | United Kingdom | 297/397 |

*Primary Examiner*—Peter R. Brown
*Attorney, Agent, or Firm*—Kriegsman & Kriegsman

[57] ABSTRACT

A headrest adapted to be removably mounted on a chair. In a preferred embodiment, the headrest comprises a pillow. The pillow comprises an insert and a case, the insert being removably housed within the case. The headrest also comprises a pouch which is appropriately sized and shaped to removably receive therewithin the pillow or other small items, such as a pair of sunglasses, a wallet or the like. The headrest further comprises three flexible, stretchable straps. A first of the three straps is attached at one end to the pillow and at the opposite end to the pouch. A second of the three straps is attached at one end to the pillow. A third of the three straps is attached at one end to the pouch. The free ends of the second and third straps are removably connected to one another by a buckle. The headrest of the present invention may be used to secure a towel to a chair.

7 Claims, 3 Drawing Sheets

HEADREST

BACKGROUND OF THE INVENTION

The present invention relates generally to headrests and more specifically to a novel headrest mountable on a chair.

Headrests or cushions mountable on chairs, sofas or the like are shown and described in many patents. Typically, such headrests or cushions include a pillow and one or more straps for removably attaching the pillow to a chair, sofa or the like. Some such headrests are designed for outdoor use, for example, being adapted for attachment to a beach or lawn chair.

In U.S. Pat. No. 4,815,154, which issued to Grimes on Mar. 28, 1989, there is disclosed an inflatable pillow usable outdoors and capable of resisting displacement by the wind or other force. The pillow has a pocket that may be filled with sand to weigh it down. The pillow also has an attached flap to keep the sand positioned in the pocket after the pillow is inflated. The pillow also has a pair of straps that can detachably fasten to the flap or pillow and form two loops, which loops can be used to attach the pillow to a beach or lawn chair.

In U.S. Pat. No. 5,027,457, which issued to Sweet on Jul. 2, 1991, there is disclosed a pillow having extended arms and legs, the arms being semi-circular and of sufficient length to enable them to extend around the torso of a human body and enable the pillow to cling to the body and support the neck or back. The pillow, and/or an external pillow case or removable cover, can be decorated to make the pillow an ornamental design, or caricature, as of a person or animal. The cover can simulate an article of clothing and is adapted to permit the arms and legs of the pillow to retain their initial appearance.

Other patents of interest include U.S. Pat. No. 4,165,125 to Owen, U.S. Pat. No. 2,013,481 to Stonehill, U.S. Design Pat. No. 338,587 to Hamish, U.S. Design Pat. No. 330,989 to Evans, U.S. Design Pat. No. 312,019 to Woods et al, U.S. Design Pat. No. 286,239 to Scheurer et al, U.S. Design Pat. No. 250,835 to Grube, and U.S. Design Pat. No. 247,312.

SUMMARY OF THE INVENTION

It is an object of the present invention to provide a new and improved headrest.

It is another object of the present invention to provide a novel headrest that is adapted to be removably secured to a chair, for example, a beach or lawn chair.

It is still another object of the present invention to provide a headrest that can be used to securely mount a towel to a chair.

It is still yet another object of the present invention to provide a headrest that is portable and that, if desired, can be worn by a person when not in use.

In furtherance of the above and other objects to be described in or apparent from the description below, a headrest constructed according to the teachings of the present invention is hereinafter provided, the headrest being adapted to be removably secured to a chair and comprising (a) a pouch; (b) a pillow; and (c) means for removably securing said pillow and said pouch to a chair.

In a preferred embodiment, the pillow is generally rectangular and includes an insert and a case, the insert being removably disposed within the case. The pouch is also generally rectangular and is adapted to permit the pillow and/or small items to be inserted thereinto and removed therefrom. A first strap of flexible, stretchable material is attached at one end to the pillow and at the opposite end to the pouch. A second strap of flexible, stretchable material is attached at one end to the pillow, and a third strap of flexible, stretchable material is attached at one end to the pouch. A releasable buckle is used to interconnect the free ends of the second and third straps.

The present invention is also directed to a method of securing a towel to a chair, said method comprising the steps of: (a) laying a towel over a chair; (b) providing a headrest comprising (i) a pouch, (ii) a pillow, and (iii) means for securing said pillow and said pouch to a chair; and (c) securing said headrest to the chair over the towel.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
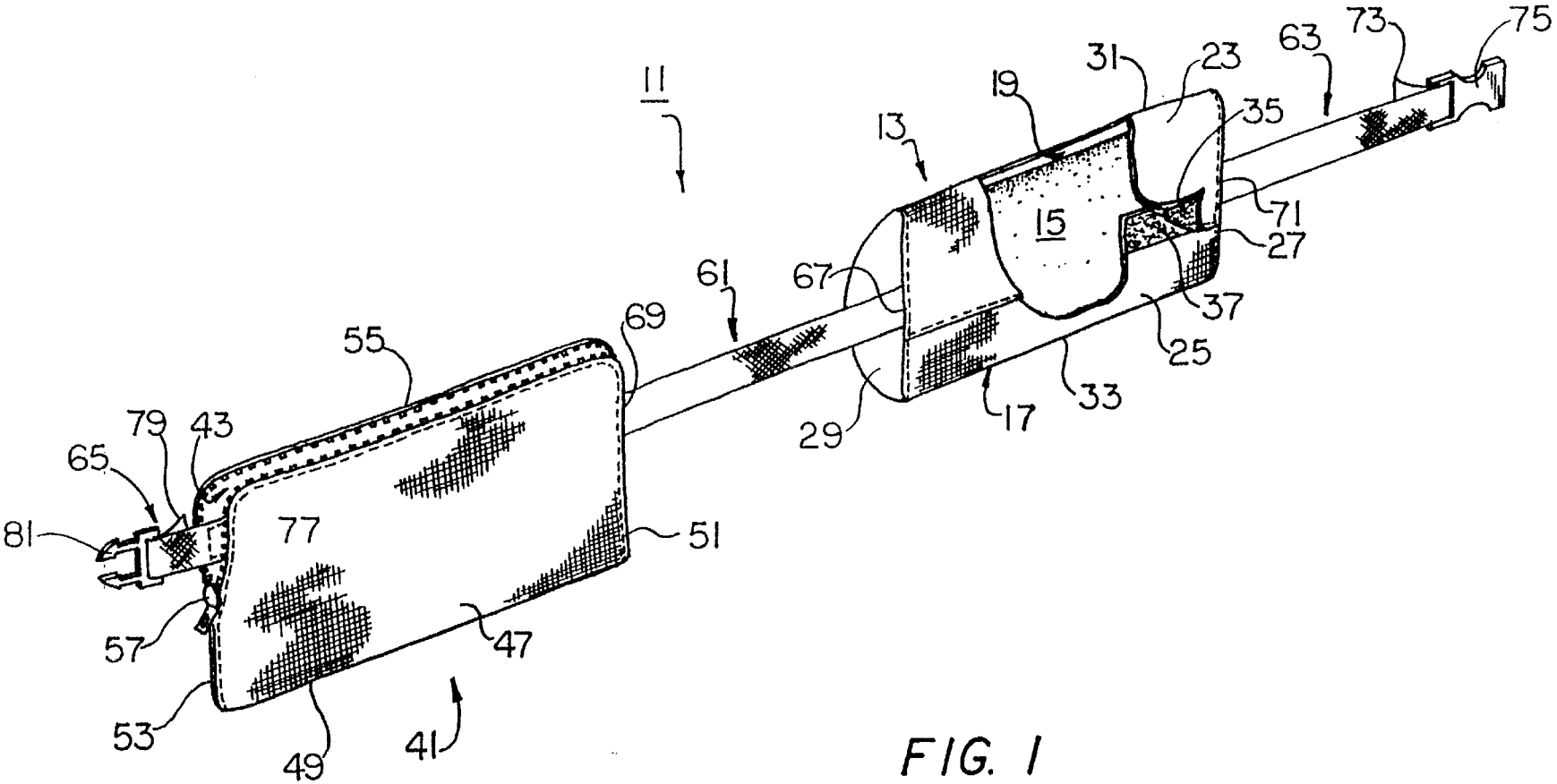
FIG. 1 is a rear perspective view, broken away in part, of one embodiment of a headrest constructed according to the teachings of the present invention.
Figure 2:
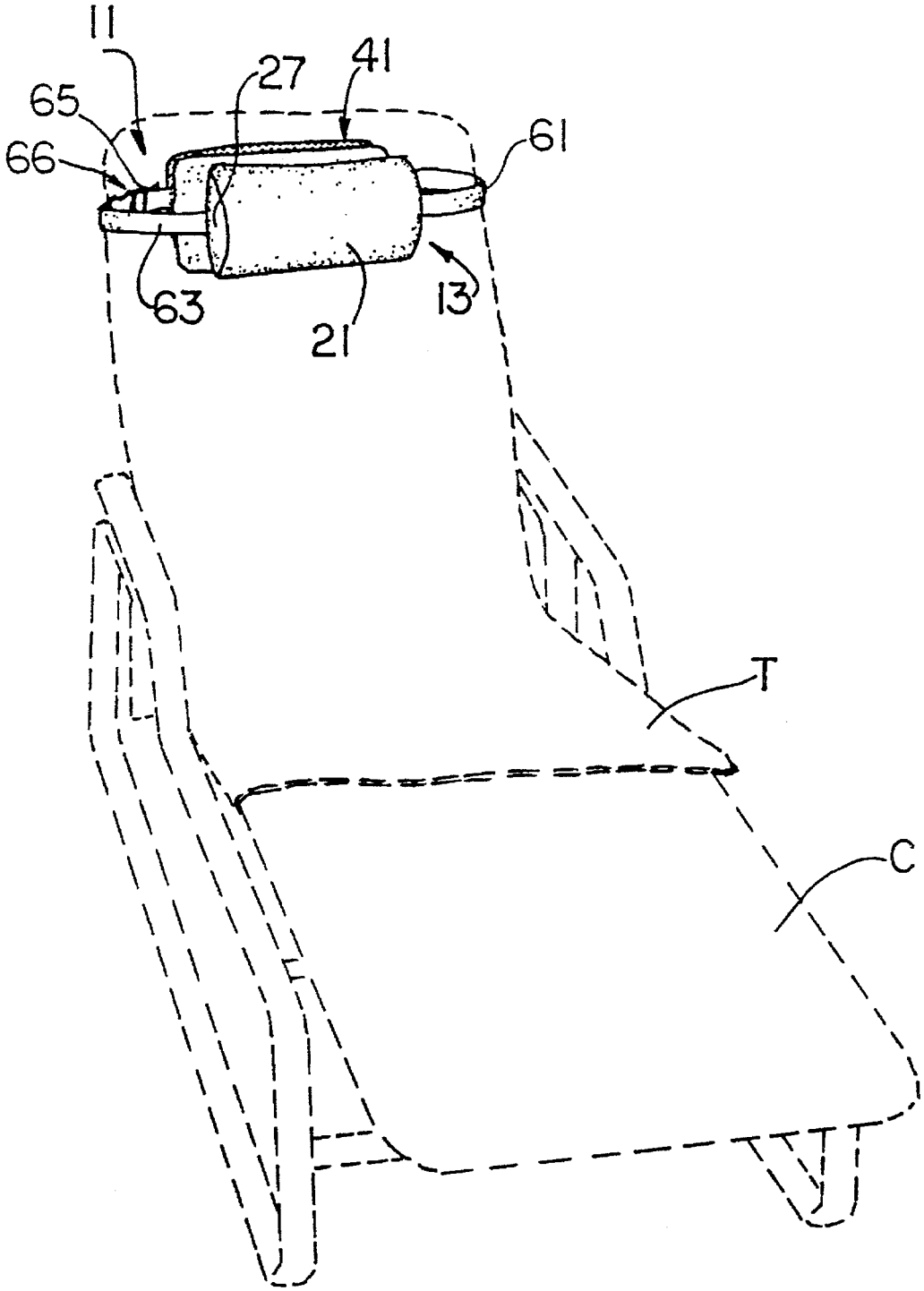
FIG. 2 is a front perspective view of the headrest of FIG. 1, a chair and a towel being shown in phantom to illustrate how the headrest may be mounted on a chair over a towel.
Figure 3:
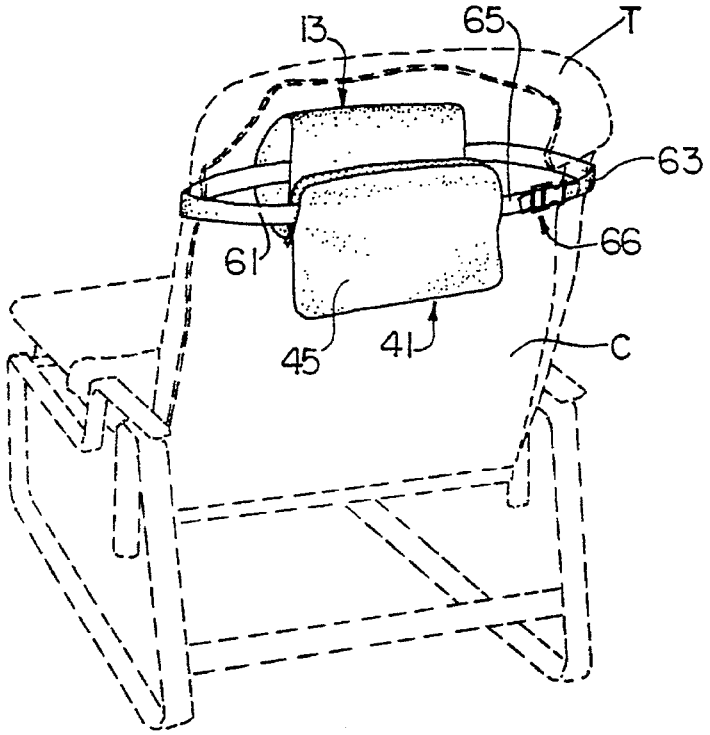
FIG. 3 is a rear perspective view of the headrest of FIG. 1, a chair and a towel being shown in phantom to illustrate how the headrest may be mounted on a chair over a towel.

Referring now to FIGS. 1 through 3, there are shown various views of a headrest adapted to be removably secured to a chair, the headrest being constructed according to the teachings of the present invention and being represented generally by reference numeral 11.

Headrest 11 comprises a pillow 13. Pillow 13 is generally rectangular in shape and includes an insert 15 and a case 17, insert 15 being removably disposed within case 17. Insert 15 may be made of foam, rubber, or other similar cushioning material. Case 17 may be constructed from a sheet of cloth, canvas, or other similar fabric material, which has been folded and stitched together in such a way as to define a cavity 19 bounded by a front portion 21, a top rear portion 23, a bottom rear portion 25, a left end portion 27, a right end portion 29, a top portion 31 and a bottom portion 33. First fastening means 35 is attached to the inside of top rear portion 23, and complementary fastener means 37 is attached to the outside of bottom rear portion 25 in such a way that top rear portion 23 and bottom rear portion 25 may be fastened and unfastened to one another. In this manner, access to cavity 19 (for inserting or removing insert 15) may be regulated. First fastening means 35 and complementary fastening means 37 are preferably hook and loop fastening material, such as the material sold under the VELCRO trademark. Another type of fastening material may be resealable pressure-sensitive adhesive tape. Other like fastening materials may also be used.

Headrest 11 also comprises a pouch 41. In the present embodiment, pouch 41 comprises a sheet of cloth, canvas, or other similar fabric material, which has been folded and stitched together in such a way as to define a cavity 43 bounded by a from portion 45, a rear portion 47, a bottom portion 49, a left end portion 51, a right end portion 53, and an open top 55. Cavity 43 is sized and shaped to removably receive therewithin pillow 13 and/or other small items (e.g., sunglasses, a wallet, etc.) through open top 55. A zipper 57 is attached to open top 55 to regulate access to cavity 43. Instead of zipper 57, VELCRO strips, buttons or other fasteners may be employed.

Headrest 11 further includes means for securing pillow 13 and pouch 41 to a chair. In the present embodiment, said securing means comprises three flexible, stretchable straps 61, 63 and 65, respectively, and an adjustably-mounted, snap-type buckle 66 for reversibly interconnecting straps 63 and 65.

Strap 61 has a first end 67 and a second end 69, first end 67 being sewn onto right end portion 29 of case 17 and second end 69 being sewn onto the inside of the left end portion 51 of pouch 41. Strap 63 has a first end 71 and a second end 73, first end 71 being sewn onto left end portion 27 of case 17 and second end 73 being threaded through the female component 75 of buckle 66 so that female component 75 may be adjustably positioned at a variety of locations along the length of strap 63. Strap 65 has a first end 77 and a second end 79, first end 77 being sewn onto the inside of right end portion 53 of pouch 41 and second end 79 being threaded through the male component 81 of buckle 66 so that male component 81 may be adjustably positioned at a variety of locations along the length of strap 65. To connect second end 73 of strap 63 to second 79 of strap 65, male component 81 of buckle 66 is inserted into female component 75 of buckle 66.

Headrest 11 may be mounted directly on a chair or may be mounted over a towel T placed on a chair C for the additional purpose of securing the towel T to the chair C (see FIGS. 2 and 3). To mount headrest 11 directly on a chair, the following steps may be taken: First, with male component 81 decoupled from female component 75, pillow 13 is positioned, where desired, on the from of the chair (typically, somewhere along the backrest of the chair) and pouch 41 is positioned, where desired, on the back of the chair. Next, male component 81 is inserted into female component 75 to secure headrest 11 to the chair. If desired, the placement of male component 81 along strap 65 and/or the placement of female component 75 along strap 63 may be adjusted for a tighter or looser fit.

To mount headrest 11 over a towel on a chair, a similar sequence of steps to that described above is followed, with an additional step being included that, prior to positioning pillow 13 on the front of the chair, the towel is placed over the chair.

When not in use, headrest 11 may be mounted on a person in a similar manner to that described above for mounting headrest 11 on a chair. By so doing, headrest 11 may be easily transported in a "hands-free" manner.

Figure 4:
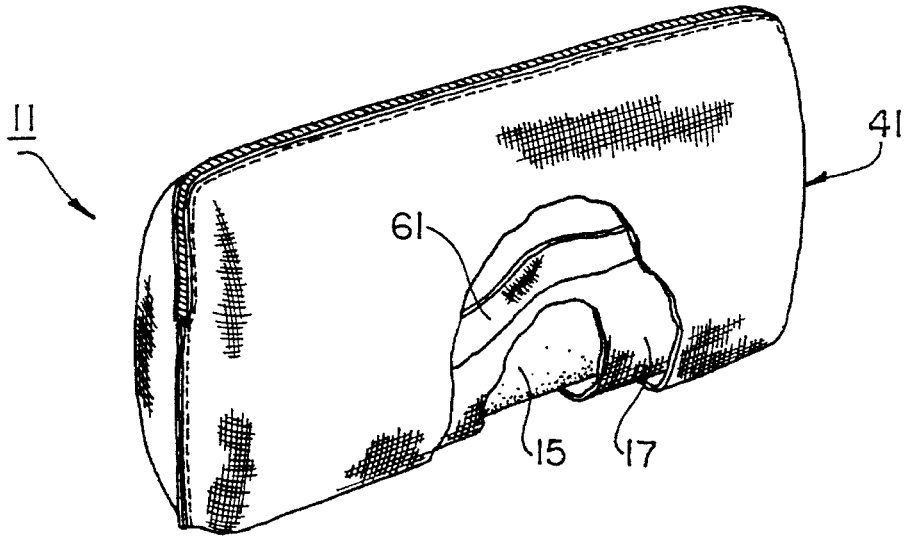
FIG. 4 is a rear perspective view, broken away in part, of the headrest of FIG. 1, illustrating how the pillow, straps and buckle may be removably housed inside the pouch.

Alternatively, when headrest 11 is not in use, pillow 13, straps 61, 63 and 65 and buckle 66 all can be housed within pouch 15 (see FIG. 4), thereby facilitating storage and transport of headrest 11.

It is to be understood that, whereas in the embodiment shown and described herein, pillow 13 comprises insert 15 and case 17, pillow 13 could consist solely of insert 15 or could consist of a sealed case of appropriate material which has been filled with air or the like.

Also, it is to be understood that means other than buckle 66, such as VELCRO, adhesives, and the like, could be used to interconnect straps 63 and 65.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A headrest adapted to be removably secured to a chair, said headrest comprising:

a) a pouch having a left end portion and a right end portion;

b) a pillow including a cushion material and having a left end portion and a right end portion;

c) a first strap having a first end connected to the right end portion of said pillow and a second end connected to the left end portion of said pouch;

d) a second strap having a first end attached to the left end portion of said pillow and a second end;

e) a third strap having a first end attached to the right end portion of said pouch and a second end;

f) a buckle connected to said second strap and said third strap for releasably securing said second strap to said third strap; and g) whereby, said headrest may be placed around the chair and removably secured in place thereto; and h) wherein said pillow and said pouch are sized and interconnected in such a way that said pillow may be removably inserted into said pouch when said pillow is not being secured to the chair.

2. The headrest as claimed in claim 1 wherein said pillow comprises a case and an insert, said insert being disposed within said case.

3. The headrest as claimed in claim 1 wherein said first strap, said second strap and said third strap are formed of an elastic material.

4. The headrest as claimed in claim 1 wherein said buckle comprises a female component connected to said second strap and a male component connected to said third strap, said male component being releasably fastenable with said female component.

5. The headrest as claimed in claim 4 wherein said buckle is adjustable, said male component being adjustably positionable along the length of said third strap and said female component being adjustably positionable along the length of said second strap.

6. A headrest adapted to be removably secured to a chair, said headrest comprising:

a) a pouch having a left end portion and a right end portion;

b) a pillow including a cushion material and having a left end portion and a right end portion;

c) a first strap having a first end connected to the right end portion of said pillow and a second end connected to the left end portion of said pouch;

d) a second strap having a first end attached to the left end portion of said pillow and a second end;

e) a third strap having a first end attached to the right end portion of said pouch and a second end; and f) whereby, said second strap and said third strap are connectable for removably securing said headrest to a chair; and g) wherein said pillow and said pouch are sized and interconnected in such a way that said pillow may be removably inserted into said pouch when said pillow is not being secured to the chair.

7. A headrest adapted to be removably secured to a chair, said headrest comprising:

a) a pouch having a left end portion, a right end portion, an open top so as to define a cavity, and a zipper for closing said open top;

b) a pillow having a left end portion, a right end portion, a case and an insert including a cushion material and;

c) a first strap formed of an elastic material, said first strap having a first end connected to the right end portion of said pillow and a second end connected to the left end portion of said pouch;

d) a second strap formed of an elastic material, said second strap having a first end attached to the left end portion of said pillow and a second end;

e) a third strap formed of an elastic material, said third strap having a first end attached to the right end portion of said pouch and a second end;

f) an adjustable buckle having a female component connected to said second strap and a male component connected to said third strap said male component being releasably fastenable with said female component for releasably securing said second strap to said third strap; and g) whereby, said headrest may be placed around the chair and removably secured in place thereto upon fastening the male component of said adjustable buckle to the female component of said adjustable buckle; and h) wherein said pillow and said pouch are sized and interconnected in such a way that said pillow may be removably inserted into said pouch when said pillow is not being secured to the chair.

* * * * *